US008480076B2

(12) United States Patent
Staff et al.

(10) Patent No.: US 8,480,076 B2
(45) Date of Patent: Jul. 9, 2013

(54) MEDIA HANDLING

(75) Inventors: Philip K. Staff, Fife (GB); Kevin G. Leeper, Angus (GB)

(73) Assignee: NCR Corporation, Duluth, GA (US)

( * ) Notice: Subject to any disclaimer, the term of this patent is extended or adjusted under 35 U.S.C. 154(b) by 158 days.

(21) Appl. No.: 12/570,433

(22) Filed: Sep. 30, 2009

(65) Prior Publication Data

US 2011/0074096 A1 Mar. 31, 2011

(51) Int. Cl.
*B65H 1/00* (2006.01)

(52) U.S. Cl.
USPC ..... 271/162; 271/145

(58) Field of Classification Search
USPC .. 271/145, 162, 9.11; 312/215, 222; 292/216, 292/232, 233, 234, 236, 238, 134, 230, 231; 399/110, 393; 70/78–88; 109/45, 47, 52, 109/53, 56, 57; 194/206, 207, 257, 350; 209/534; 902/8–21
See application file for complete search history.

(56) References Cited

U.S. PATENT DOCUMENTS 2,842,419 A * 7/1958 Howard ..... 312/218
4,872,659 A * 10/1989 Kato et al. ..... 271/9.01

FOREIGN PATENT DOCUMENTS

JP 1-256434 * 10/1989
JP 4-323130 * 11/1992

* cited by examiner

*Primary Examiner* — Thomas Morrison
(74) *Attorney, Agent, or Firm* — Michael Chan; Paul W. Martin

(57) ABSTRACT

A media handler comprises a pick unit arranged to receive a media cassette defining a stub; a detent mounted on the pick unit and resiliently biased to protrude into a path traversed by the stub until deflected by the stub; and a latch pivotably mounted to the pick unit. The latch defines: (i) a flag portion and (ii) a recess engagable by the stub as the cassette is fully inserted into the pick unit. The latch is moveable between (i) an open position in which the detent prevents the latch from moving and (ii) a closed position in which the detent has been deflected by the stub and the recess engages with the stub. Complete insertion of the cassette causes the stub to deflect the detent out of the path, thereby allowing the latch to pivot from the open to the closed position and the recess to engage with the stub to lock the cassette in position.

11 Claims, 6 Drawing Sheets

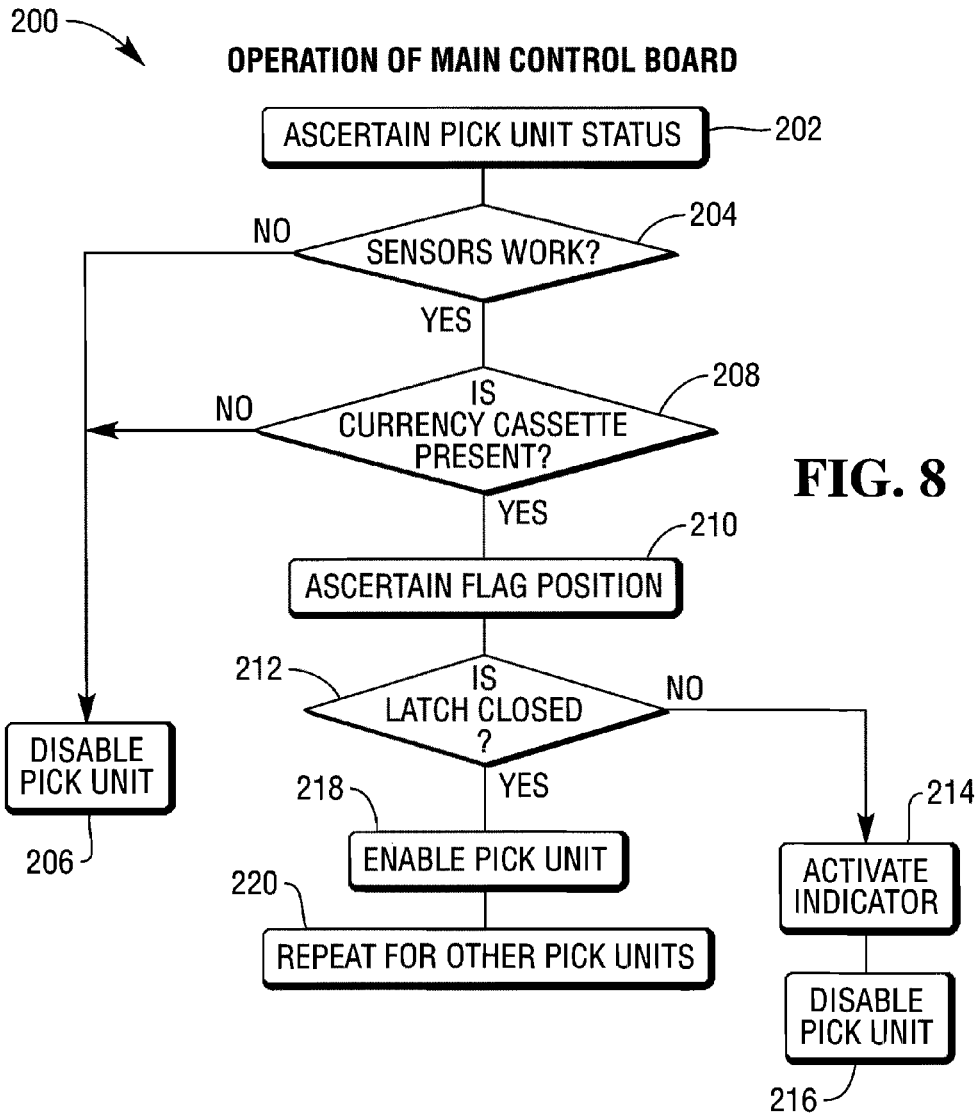
FIG. 8
FIG. 10
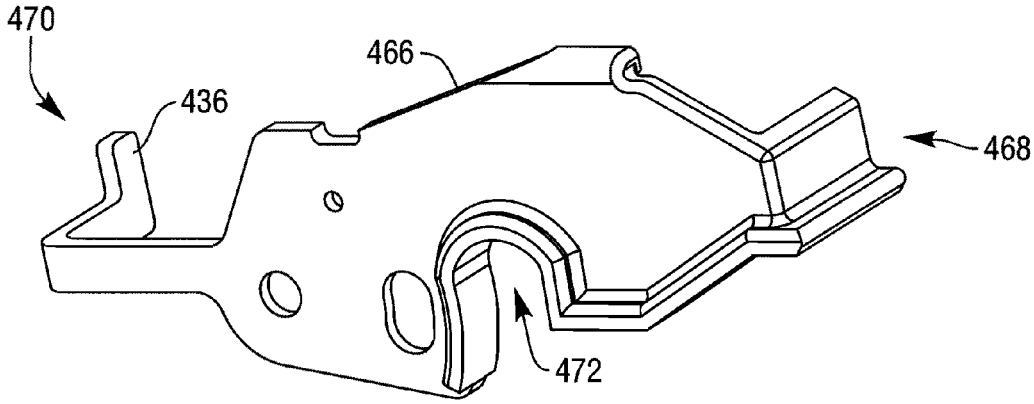

MEDIA HANDLING

FIELD OF INVENTION

The present invention relates to improvements in or relating to media handling.

BACKGROUND OF INVENTION

Media handlers transport media items in sheet form so that they can be dispensed from, and/or stored in, the media handler. Media handlers can be incorporated into self-service terminals, such as automated teller machines (ATMs).

One problem with ATM media handlers (such as cash dispensers and cash recyclers) is that when a cash replenisher (that is, a person who replenishes the ATM with cash) replaces a currency cassette within the media handler, he/she may not fully insert the new currency cassette. This means that when the media handler attempts to pick banknotes from the cassette, the action of picking a banknote may push out the cassette, and cause a failed pick operation. This may also force the ATM to go out of service until a replenisher returns to insert the cassette fully.

SUMMARY OF INVENTION

Accordingly, the invention generally provides methods, systems, apparatus, and software for an improved media handler including an improved latch.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects of the invention may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a media handler comprising:

a pick unit arranged to receive a media cassette defining a stub;

a detent mounted on the pick unit and resiliently biased to protrude into a path traversed by the stub until deflected by the stub;

a latch pivotably mounted to the pick unit and defining (i) a flag portion and (ii) a recess engagable by the stub as the cassette is fully inserted into the pick unit, the latch being moveable between (i) an open position in which the detent prevents the latch from moving and (ii) a closed position in which the detent has been deflected by the stub and the recess engages with the stub;

whereby complete insertion of the cassette causes the stub to deflect the detent out of the path, thereby allowing the latch to pivot from the open to the closed position and the recess to engage with the stub to lock the cassette in position.

The latch may further comprise a resilient member to bias the latch to the closed position when the detent is deflected out of the path. The resilient member may comprise a coil spring, a leaf spring, or the like.

The path is preferably linear, but may be arcuate.

The latch may include a body extending generally parallel to a sidewall of the pick unit. The body may be coupled to the sidewall by a pivot mounted in a pivot aperture defined by the body. The resilient member may be mounted on the pivot.

The flag portion may be provided at an opposite end of the body to the recess. The flag portion may comprise a portion extending transversely to the body and protruding through the pick unit sidewall.

The recess may define a vertical surface for engaging with a corresponding vertical surface on a rearward (non-inserted) end of the stub of the cassette so that, in normal operation, once the latch has engaged the cassette it cannot be moved out of the pick unit (rearwards) until the latch is disengaged.

The flag portion may be arranged to block a sensor when the latch is moved to the closed position, but not to block the sensor when the latch is in the open position. The sensor may comprise an emitter radiating a beam towards a detector such that when the recess engages with the stub, the flag portion blocks the beam, either partially or completely.

The media handler may include a main control board populated with control electronics to provide a first indicator to indicate when the media handler is configured correctly, and a second indicator to indicate when the media handler is incorrectly configured.

The first indicator may comprise a visual indicator (for example a green LED), an audible indicator (for example, a tone), a combination of visual and audible indicators, or the like.

The second indicator may comprise a visual indicator (for example a red LED), an audible indicator (for example, a buzzer), a combination of visual and audible indicators, or the like.

The main control board may disable operation of the media handler until the latch is sensed in the closed position.

The media handler may further comprise a pick control board (separate from the main control board) coupled to the pick unit.

The latch may be composed of a transparent or translucent material, such as acrylic or clear polycarbonate.

The pick control board may include a cassette indicator. The cassette indicator may be arranged to illuminate the flag portion when the latch is in the closed position. The pick control board may include a plurality of cassette indicators, for example, a green cassette indicator and a red cassette indicator, such that when the latch is in the open position the red indicator illuminates the flag portion; whereas, when the latch is in the closed position the green indicator illuminates the flag portion.

The latch may be configured as a light pipe to propagate light from the cassette indicator to a front portion of the latch so that a replenisher can ascertain that the latch is in the closed position by observing the light emitted by the cassette indicator and propagating through the latch. The cassette indicator may emit green light.

The latch may be configured as a light pipe by the shape of the latch and/or by including a surface finish to facilitate total internal reflection within the latch, thereby allowing the indicator to propagate a light beam within the latch and illuminate the latch. The surface finish may include abrasion to provide a rough surface, or the surface finish may include a thin layer of high refractive index material. Suitable surface finish materials include polyethylene terephthalate (PET) and triacetyl cellulose (TAC). Although a relatively high degree of total internal reflection is desirable (to ensure that the entire latch is illuminated), sufficient light must escape so that the illumination is visible. The flag portion may not include a surface finish to ensure that light can be propagated into the latch.

The media handler may comprise a cash dispenser, a cash recycler, a cash depository, or the like.

The media handler may comprise a plurality of pick units, each having its own pick control board.

By configuring the latch as a light pipe, and by providing illumination of the latch when it is fully inserted, a replenisher can easily ascertain if the cassette being inserted has been inserted fully without having to look at a secondary display (such as a service engineer panel). Furthermore, where multiple cassettes are inserted into a media handler, the replenisher can easily ascertain which of the inserted cassettes has not been inserted correctly by looking for a latch that is not illuminated, or not illuminated with the correct colour.

This aspect has the advantage that the action of inserting a cassette into a media handler releases the latch that engages with the cassette, and movement of the latch causes a flag portion to be detected by a sensor that confirms that the latch is in the correct position for dispensing media therefrom or inserting media therein.

According to a second aspect there is provided a self-service terminal including the media handler of the first aspect.

According to a third aspect there is provided a method of receiving a media cassette into a media handler, the method comprising:

receiving a media cassette defining a stub;

releasing a latch when the stub deflects a detent protruding into a path of the stub urging the latch into a closed position in which a recess in the latch engages with the stub to lock the cassette in position when the stub deflects the detent; and detecting a flag portion on the latch when the latch moves into the closed position.

The method may comprise the further step of illuminating the flag portion on the latch when the latch moves into the closed position.

These and other aspects will be apparent from the following specific description, given by way of example, with reference to the accompanying drawings.

BRIEF DESCRIPTION OF THE DRAWINGS

FIG. 8 is a flowchart illustrating steps involved in the media handler of FIG. 1 ascertaining if currency cassettes are correctly inserted therein;

FIG. 10 is a simplified pictorial view of a latch according to a second embodiment of the present invention.

DETAILED DESCRIPTION

Figure 1:
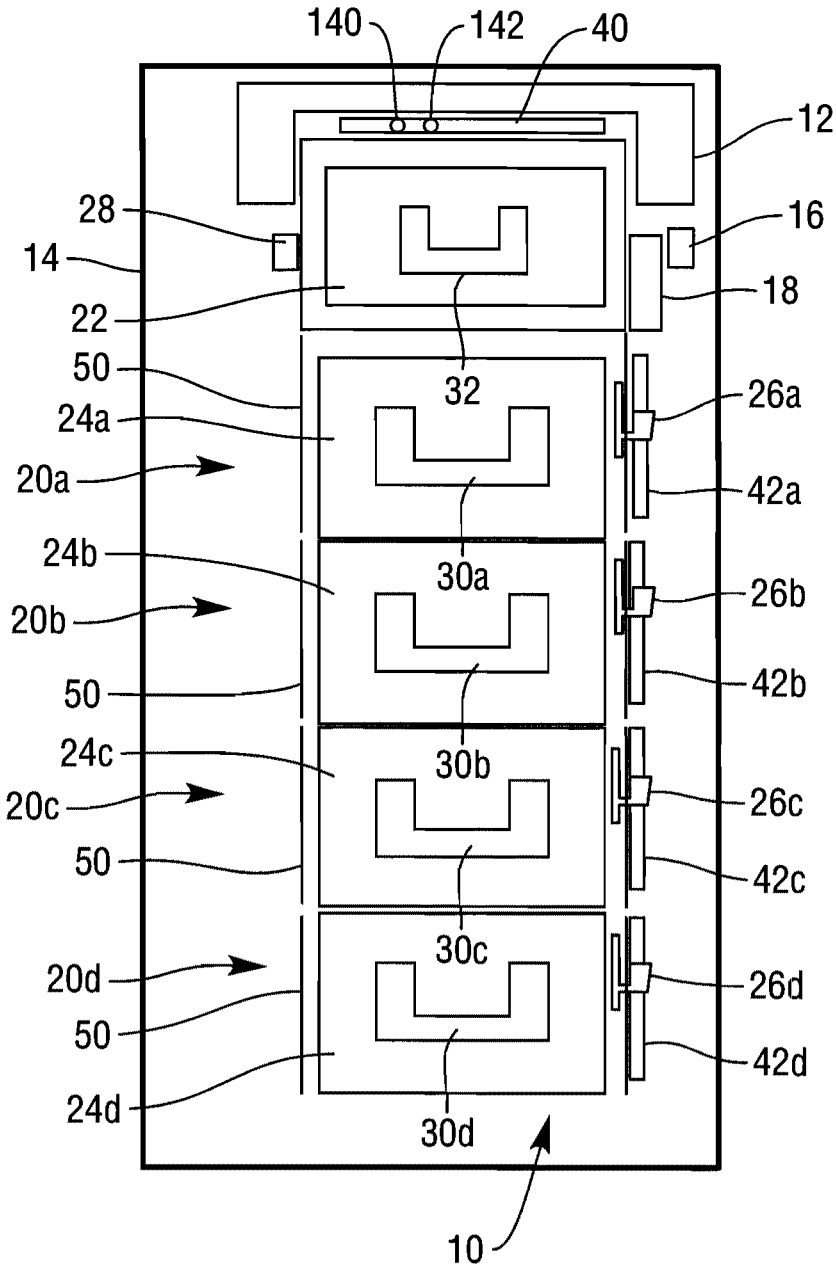
FIG. 1 is a front pictorial view of a media handler according to one embodiment of the present invention located within a safe of a self-service terminal.

Reference is first made to FIG. 1, which is a front pictorial view of a media handler 10, in the form of a cash dispenser, according to one embodiment of the present invention.

The cash dispenser 10 is mounted on a telescopic rail mechanism 12 within a safe 14. The telescopic rail mechanism 12 allows the cash dispenser 10 to be pulled out (referred to as racked out) for replenishment or servicing, and pushed back in (racked in) to engage with a dispenser slot (not shown) in an ATM fascia (not shown) for normal operation. In operational mode the cash dispenser 10 is racked in; whereas, in maintenance mode, the cash dispenser 10 is racked out.

The telescopic rail mechanism 12 latches shut when the cash dispenser 10 is fully racked in, and is released by a user (who may be a replenishment person or a maintenance person) pushing a release lever 16 sideways, thereby allowing the user to rack out the cash dispenser 10 by pulling on a handle 18.

The cash dispenser 10 is a four-high dispenser comprising four identical pick units 20*a,b,c,d* that are vertically coupled together, and a purge bin 22 on top of the pick units 20. Each pick unit 20 receives and houses a currency cassette 24 from which the pick unit 20 picks individual banknotes.

Each currency cassette 24*a,b,c,d* is individually removable from the cash dispenser 10 by depressing a release latch 26 on the respective pick unit 28. The purge bin 22 is also individually removable by depressing a latch 28. The currency cassette 24 or purge bin 22 can then be removed using a cassette handle 30 or the purge bin handle 32 (which are removal handles).

A main control board 40 is provided at the top of the cash dispenser 10 for controlling the operation of the cash dispenser 10 and for communicating with a central controller (not shown) within the ATM (not shown).

Each pick unit 20 also has a pick unit control board 42 for controlling the operation of that pick unit 20, and a pair of sidewalls 50.

Figure 2:
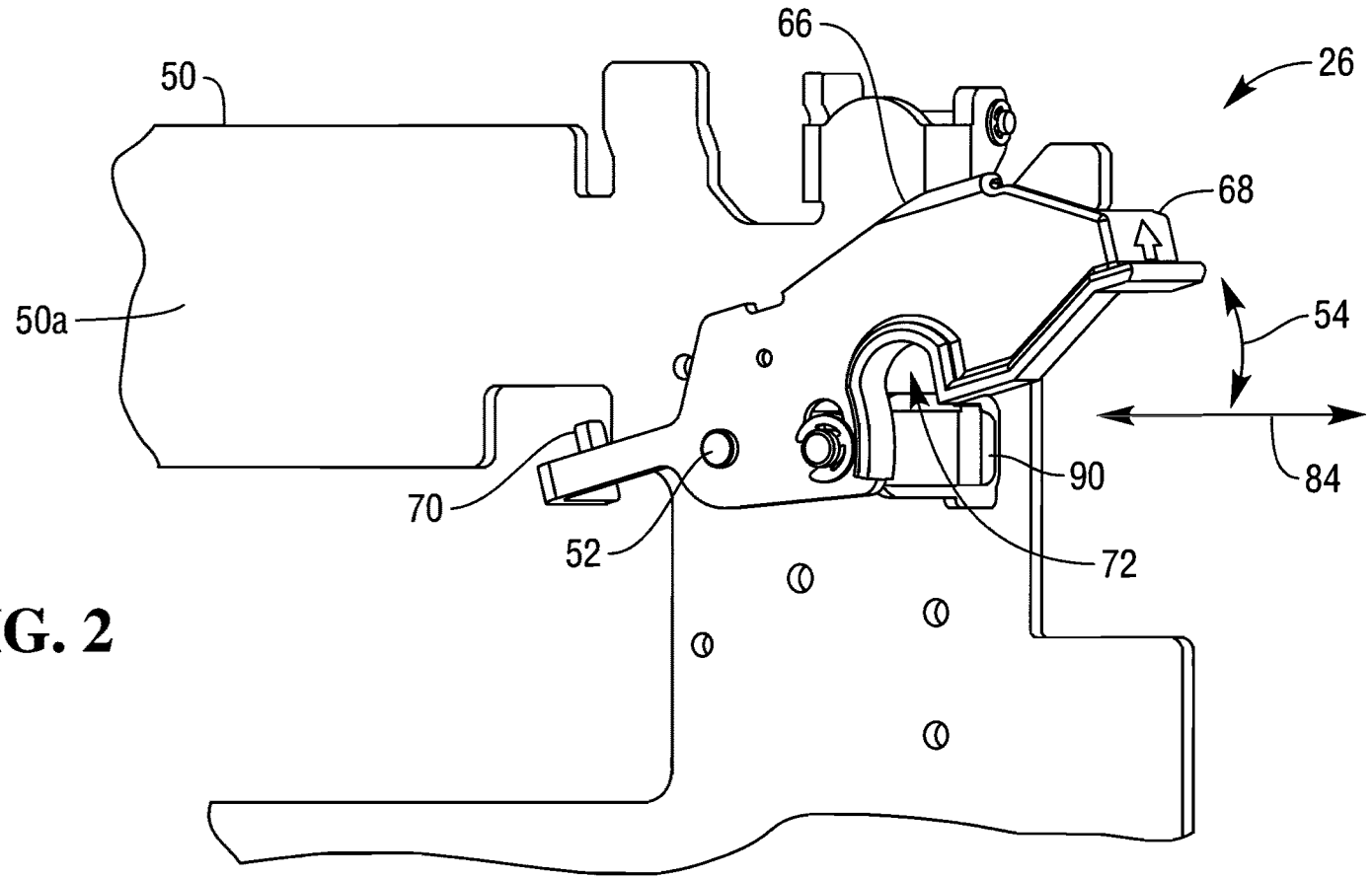
FIG. 2 is a simplified pictorial view from within a portion (one of the pick units) of the media handler of FIG. 1 showing a part (the latch) in more detail.
Figure 3:
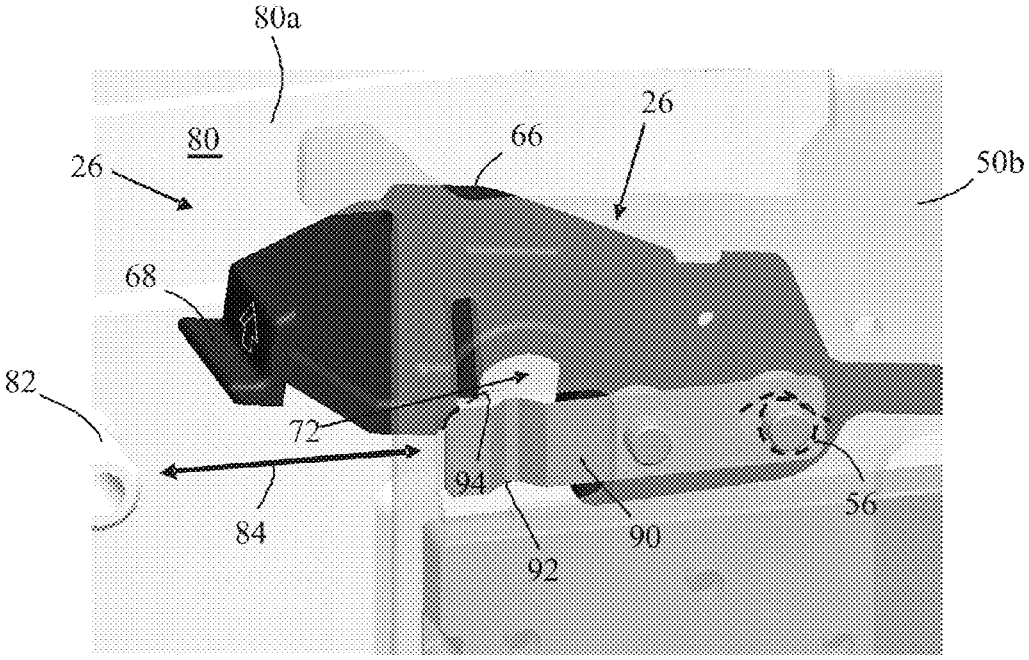
FIG. 3 is a simplified pictorial view from outside the pick unit of FIG. 2, with a cassette partially inserted therein and showing the latch in an open position.
Figure 4:
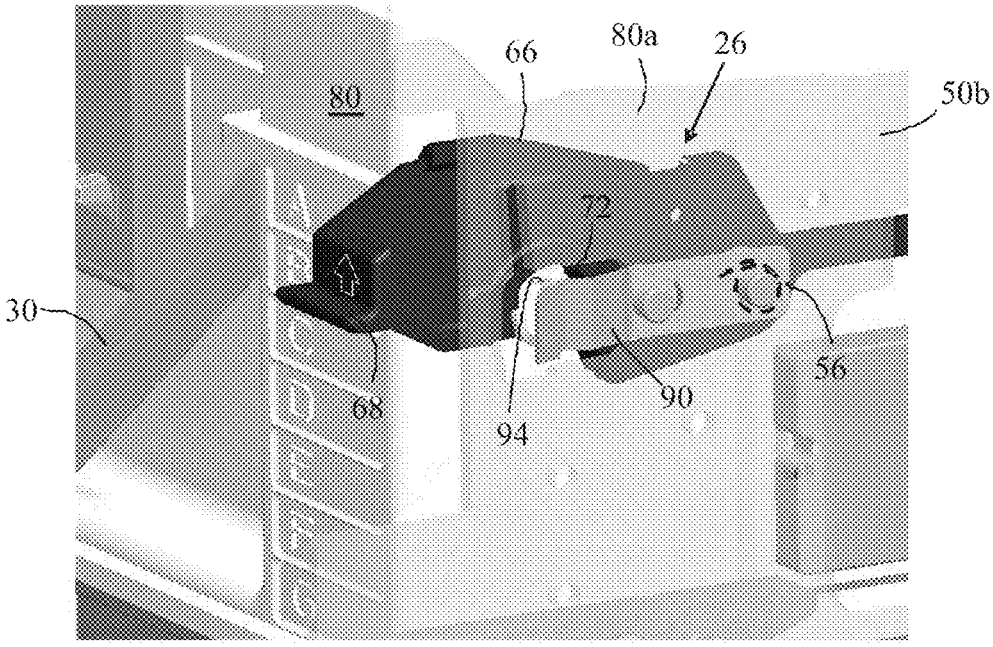
FIG. 4 is a simplified pictorial view from outside the pick unit of FIG. 2, with a cassette completely inserted therein and showing the latch in a closed position.

Reference will now also be made to FIGS. 2 to 4. FIG. 2 is a simplified pictorial view from within one of the pick units 20 showing the release latch 26 in more detail. FIGS. 3 and 4 are simplified pictorial views from outside the pick unit 20 showing the release latch 26 in an open and closed position, respectively.

Internal faces of the sidewall 50 are labelled 50*a* (FIG. 2) and external faces of the sidewall 50 are labelled 50*b* (FIG. 3).

The release latch 26 is coupled to the sidewall 50 of the pick unit 20 by a pivot (in the form of a stud) 52 mounted in a pivot aperture (not shown) in the latch 26. The pivot 52 allows the release latch 26 to move in the direction shown by double arrows 54.

A resilient member 56, in the form of a coil spring, is located around the pivot 52 to urge the release latch 26 downwards.

As shown in FIG. 2, the release latch 26 is mounted to the internal face 50*a* of the sidewall 50.

The latch 26 is formed as a single piece of moulded polycarbonate and comprises: a generally planar body portion 66, a release tab 68 extending transversely from one end of the body portion 66, a flag portion 70 extending transversely from the opposite end of the body portion 66, and a recess 72 approximately mid-way between the release tab 68 and the flag portion 70.

The body portion 66 is mounted parallel to, and on the inner face 50*a* of, the sidewall 50. The release tab 68 is substantially perpendicular to the body portion 66 and extends beyond the outer face 50*b* (FIG. 3) of the sidewall 50. The flag portion 70 is also substantially perpendicular to the body portion 66 and extends beyond the outer face 50*b* (FIG. 3) of the sidewall 50. The release tab 68 is accessible from, and proximal to, the rear of the cash dispenser 10 (the end from which the cassette handles 30 are accessible); whereas, the flag portion 70 is nearer to the front of the cash dispenser 10.

FIGS. 3 and 4 illustrate a currency cassette 80 inserted (partially in FIG. 3 and completely in FIG. 4) into the cash dispenser 10.

The currency cassette 80 defines a stub 82 extending transversely from a sidewall 80*a* of the currency cassette 80. As the currency cassette 80 is inserted and removed from the cash dispenser 10, the stub 82 traverses a path (indicated by double headed arrow 84), which will be referred to herein as the stub path 84.

A detent 90 is mounted to the inner face 50*a* of the sidewall 50. The detent 90 comprises a sheet metal clip having a corrugation 92 extending into the stub path 84, and a plate portion 94 on which the release latch body portion 66 rests. The detent 90 is inherently resilient because it is made from sheet metal, so it can be deflected by the stub 82 as the currency cassette 80 is fully inserted into the pick unit 20, as illustrated in FIG. 4. When the detent 90 is deflected by the stub 82, the plate portion 94 ceases to prevent the release latch body portion 66 from being urged downwards by the coil spring 56. Thus, when the currency cassette 80 is completely inserted into the pick unit 20, the stub 82 deflects the detent 90, which allows the coil spring 56 to urge the release latch 26 from the open position (FIG. 3) to the closed position (FIG. 4).

In the closed position, the recess 72 of the release latch 26 engages with the stub 82.

Figure 5:
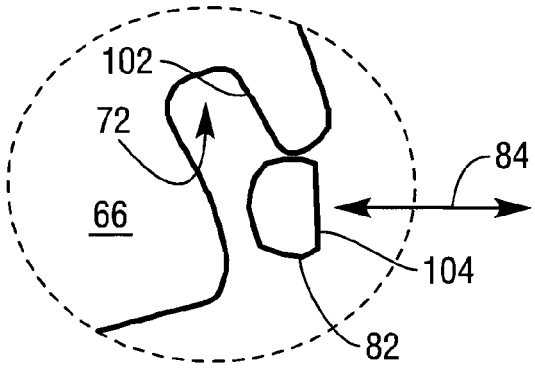
FIG. 5 is an enlarged pictorial view showing part of the latch and a cassette stub, when the latch is in the open position of FIG. 3.
Figure 6:
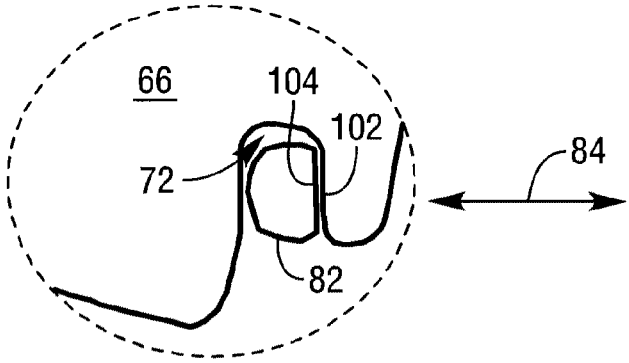
FIG. 6 is an enlarged pictorial view showing part of the latch and a cassette stub, when the latch is in the closed position of FIG. 4.

Reference will now also be made to FIGS. 5 and 6, which are enlarged pictorial views of a part of the latch body portion 66 and the stub 82, showing features thereof in more detail.

FIG. 5 shows the relative positions of the body portion 66 and stub 82 when the latch is in the open position. The recess 72 defines a straight edge 102 that is oriented vertically when the latch 26 is in the closed position. Similarly, the stub 82 defines a complementary straight edge 104 that is oriented vertically. When the latch 26 moves to the closed position, the two vertically aligned edges 102,104 ensure that the currency cassette 80 is locked in the cash dispenser 10, and cannot be removed (intentionally or accidentally) until the release tab 68 is lifted.

Figure 7:
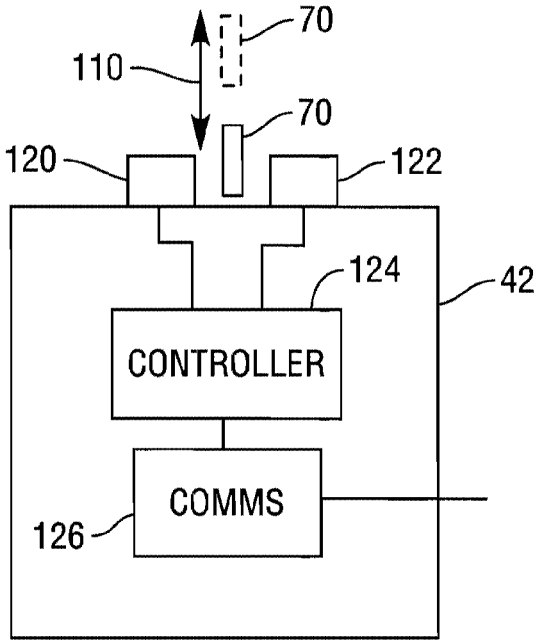
FIG. 7 is a simplified schematic diagram showing two interacting parts (the pick unit control board and the flag portion of the latch) of the media handler of FIG. 1.

Reference will now also be made to FIG. 7, which is a simplified schematic diagram of the pick unit control board 42 and the flag portion 70. As illustrated by double headed arrow 110, the flag portion 70 moves from a first position (illustrated by broken lines) when the latch 26 is in the open position, to a second position (illustrated by solid lines) when the latch 26 is in the closed position.

The pick unit control board 42 comprises: an infra-red (IR) beam emitter 120; an IR beam detector 122 disposed opposite and aligned with the IR beam emitter 120; a controller 124 for controlling the entire operation of the pick unit 20, including sensing the presence or absence of the flag portion 70 from between the IR emitter 120 and detector 122; and a communications circuit 126 coupled to the controller 124.

The pick unit control board 42 comprises further circuitry (not shown) linked to the controller 124 for performing pick operations and the like, but these operations are well known so will not be described herein.

The communications circuit 126 communicates data to the main control board 40, including whether the flag portion 70 is currently in the second position (indicative of the latch 26 being in the closed position) or not.

Reference will now also be made to FIG. 8, which is a flowchart 200 illustrating steps performed by the main control board 40 in ascertaining which pick units 20, if any, should be activated for normal operational service. This process 200 is performed for each pick unit 20. This process 200 is implemented whenever the cash dispenser 10 is returned to normal operating mode from supervisor mode (which occurs immediately after a replenishment operation is performed).

It should be appreciated that this process involves using many conventional sensors (pick position, vacuum pressure, and the like) that are not specifically related to this invention, so they are not described in detail herein.

Although not described above, the cash dispenser 10 includes sensors (not shown) for detecting magnets (not shown) within each currency cassette 80. These magnetic detection sensors (not shown) can ascertain if a currency cassette 80 is present in the associated pick unit 20, but are not sensitive enough to ascertain the exact position of the currency cassette 80 within the pick unit 20, so they cannot be used to detect if the currency cassette 80 has been completely inserted or not.

Initially, the main control board processor (not shown) communicates with one of the four pick unit control boards 42 (step 202) to ascertain the status of the conventional sensors (not shown) within that pick unit 20 (step 204).

If the conventional sensors in a pick unit 20 are not functioning correctly then the main control board 40 will disable that pick unit 20 (step 206).

If the conventional sensors in a pick unit 20 are functioning correctly, then the main control board 40 ascertains if there is a currency cassette 80 present in the pick unit 20 (step 208) by requesting the magnetic sensor status from the pick unit controller 124.

If the magnetic sensors (not shown) have not detected a currency cassette 80 within the pick unit 20 then the main control board 40 will disable that pick unit 20 (step 206).

If the magnetic sensors (not shown) detect a currency cassette 80 within the pick unit 20, then the main control board 40 ascertains the position of the flag portion 70 (step 210) by communicating with the pick unit control board processor 124.

If the flag portion 70 is not in the closed position (that is, the second position of FIG. 7) (step 212), then the main control board 40 activates an indicator 140 (FIG. 1) (step 214) to alert a replenisher. In this embodiment, the indicator 140 comprises a red LED that is located on the main control board 40 and is visible to a replenisher. The indicator 140 may further comprise a loudspeaker for emitting an audible sound (for example, a buzzing sound) to warn the replenisher that one or more cassettes 80 are not completely inserted into the pick units 20.

The main control board 40 will then disable that pick unit 20 (step 216) to ensure that it is not used in any customer transaction.

If the flag portion 70 is in the closed position (that is, the second position of FIG. 7) (step 212), then the main control board 40 enables the pick unit 20 for normal operation (step 218).

The main control board 40 then repeats the process 200 for the remaining pick units 20.

If all pick units 20 containing currency cassettes 80 are operational, then the main control board 40 activates an indicator 142 (FIG. 1) to indicate that the cash dispenser 10 is configured correctly (provided there are no other problems with the cash dispenser 10).

Although process 200 is illustrated as a sequence of steps, if at any time a replenisher completely inserts a currency cassette 80 that was previously only partially inserted, then the main control board 40 will detect this, verify that the conventional sensors work correctly (step 204) and that there is a currency cassette 80 present (step 208), and then deactivate the indicator 140 and enable the pick unit 20 (step 218) for use in customer transactions.

Figure 9:
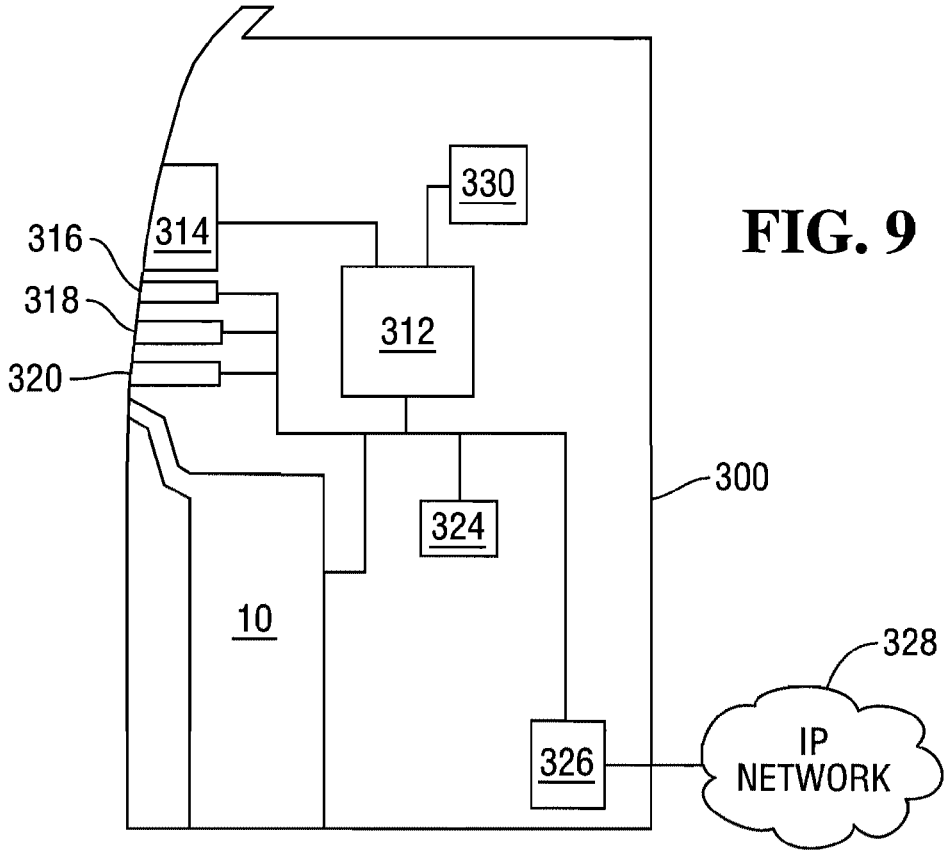
FIG. 9 is a block diagram of a self-service terminal incorporating the media handler of FIG. 1.

Reference will now be made to FIG. 9, which is a block diagram of a self-service terminal 300, in the form of an automated teller machine (ATM), including the cash dispenser 10.

The ATM 300 comprises a plurality of modules for enabling transactions to be executed and recorded by the ATM 300. These ATM modules include customer transaction modules and service personnel modules. The ATM modules comprise: an ATM controller 312, a customer display 314, a card reader/writer module 316, an encrypting keypad module 318, a receipt printer module 320, the cash dispenser 10, a journal printer module 324 for creating a record of every transaction executed by the ATM 300, a network connection module 326 for accessing a remote authorisation system (not shown) via an IP network 328, and an operator panel module 330 for use by a service operator such as a field engineer, a replenisher (of currency, of printer paper, or the like), or the like.

Alternative Embodiment of Latch

Reference will now be made to FIG. 10, which is a simplified pictorial view of a release latch 426 according to another embodiment of the present invention.

The release latch 426 is formed as a single piece of moulded, transparent, polycarbonate and comprises: a generally planar body portion 466, a release tab 468 extending transversely from one end of the body portion 466, a flag portion 470 extending transversely from the opposite end of the body portion 466, and a recess 472 approximately mid-way between the release tab 468 and the flag portion 470.

The shape and dimensions of the release latch 426 are identical to the release latch 26. The difference between release latch 26 and 426 is that release latch 426 includes a surface finish to facilitate total internal reflection within the latch 426, thereby allowing the indicator to propagate a light beam within the release latch 426 and illuminate the release latch 426.

In this embodiment, the surface finish comprises abrasion to provide a rough surface on all outer surfaces except one surface 436 (the smooth surface) on the flag portion 470.

Figure 11:
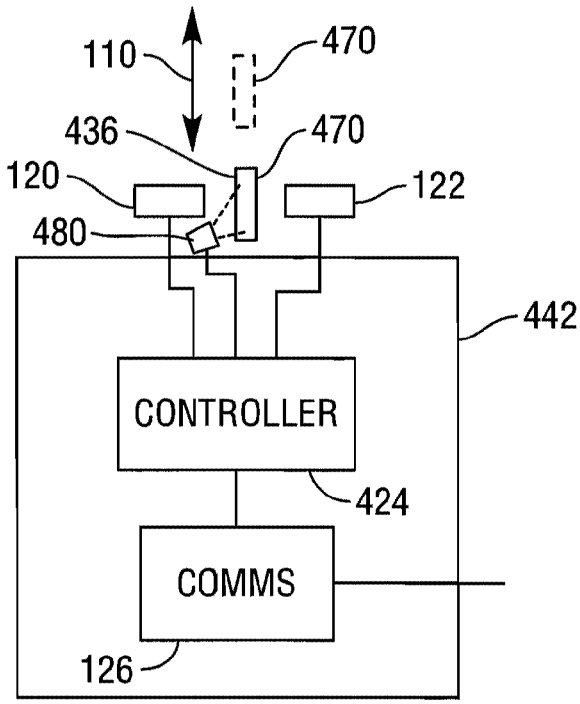
FIG. 11 is a simplified schematic diagram showing two interacting parts (a pick unit control board and a flag portion of the latch) used in the second embodiment of the present invention.

Reference will now be made to FIG. 11, which is a simplified schematic diagram showing a second type of pick unit control board 442 interacting with the flag portion 470 of the release latch 426.

The pick unit control board 442 shares many common parts with the pick unit control board 42. However, the pick unit control board 442 has a cassette indicator 480, in the form of a green LED, activated (that is, illuminated) by a modified controller 424 whenever the flag portion 470 is in the second position.

The green LED 480 is directed towards the smooth surface 436 so that green light enters the release latch 426 and is propagated therethrough. Since the entire release latch 426 is illuminated, a replenisher can easily verify that the associated currency cassette 80 has been inserted completely. Thus, the cassette indicator 480 provides immediate visual confirmation to a replenisher that a currency cassette has been inserted correctly.

Various modifications may be made to the above described embodiment within the scope of the invention, for example, in other embodiments, different types of indicator 140 may be used to those described above.

In other embodiments, the shape of the release latch may be different to that described above.

In other embodiments, a container other than a currency cassette may be used.

In other embodiments using light propagated through the release latch, the surface finish may include a thin layer of high refractive index material.

In other embodiments the media handler may receive media items rather than, or in addition to, dispensing media items.

The steps of the methods described herein may be carried out in any suitable order, or simultaneously where appropriate. The methods described herein may be performed by software in machine readable form on a tangible storage medium or as a propagating signal.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

What is claimed is:

1. A media handler comprising:

a pick unit arranged to receive a media cassette defining a stub;

a detent mounted on the pick unit and resiliently biased to protrude into a path traversed by the stub until deflected by the stub; and a latch pivotably mounted to the pick unit and defining (i) a flag portion and (ii) a recess engageable by the stub as the cassette is fully inserted into the pick unit, the latch being moveable between (i) an open position in which the detent prevents the latch from moving and (ii) a closed position in which the detent has been deflected by the stub and the recess engages with the stub, wherein complete insertion of the cassette causes the stub to deflect the detent out of the path, thereby allowing the latch to pivot from the open to the closed position and the recess to engage with the stub to lock the cassette in position;

wherein the flag portion is arranged to block a sensor when the latch is moved to the closed position, but not to block the sensor when the latch is in the open position.

2. A media handler according to claim 1, wherein the latch further comprises a resilient member to bias the latch to the closed position when the detent is deflected out of the path.

3. A media handler according to claim 2, wherein the resilient member comprises a coil spring.

4. A media handler according to claim 1, wherein the flag portion is provided at an end of a body portion of the latch, and comprises a portion extending transversely to the body portion and protruding through a pick unit sidewall.

5. A media handler according to claim 1, wherein the media handler further comprises a pick control board coupled to the pick unit, wherein the sensor is mounted to the pick control board.

6. A self-service terminal including the media handler according to claim 1.

7. A self-service terminal according to claim 6, wherein the terminal further comprises a currency cassette.

8. A media handler comprising:

a pick unit arranged to receive a media cassette defining a stub;

a detent mounted on the pick unit and resiliently biased to protrude into a path traversed by the stub until deflected by the stub; and a latch pivotably mounted to the pick unit and defining (i) a flag portion and (ii) a recess engageable by the stub as the cassette is fully inserted into the pick unit, the latch being moveable between (i) an open position in which the detent prevents the latch from moving and (ii) a closed position in which the detent has been deflected by the stub and the recess engages with the stub, wherein complete insertion of the cassette causes the stub to deflect the detent out of the path, thereby allowing the latch to pivot from the open to the closed position and the recess to engage with the stub to lock the cassette in position;

wherein the media handler includes a main control board populated with control electronics to provide a first indicator to indicate when the media handler is configured correctly, and a second indicator to indicate when the media handler is incorrectly configured; and wherein the main control board disables operation of the media handler when the latch is not sensed in the closed position.

9. A media handler according to claim 8, wherein the first and second indicators comprise visual indicators.

10. A media handler comprising:

a pick unit arranged to receive a media cassette defining a stub;

a latch pivotably mounted to the pick unit and moveable between an open position and a closed position and defining (i) a flag portion and (ii) a recess engageable by the stub as the cassette is fully inserted into the pick unit;

a deflectable detent mounted on the pick unit and resiliently biased to protrude into a path traversed by the stub of the cassette, wherein (i) the latch is movable relative to the detent and (ii) the stub deflects the detent out of the path to allow the latch to pivot from the open position to the closed position and the recess to engage with the stub to lock the cassette in position as the cassette is being inserted into the pick unit;

wherein (i) the flag portion is provided at an end of a body portion of the latch and (ii) the latch defines a release tab portion at an opposite end of the body portion of the latch such that the recess is located substantially between the flag portion and the release tab portion;

wherein the deflectable detent comprises (i) a sheet metal clip having a corrugation which extends into the path and (ii) a plate portion on which the body portion of the latch rests when the latch is in the open position;

wherein the latch further comprises a coil spring to bias the latch to the closed position when the detent is deflected out of the path; and wherein (i) the stub of the cassette defines a first straight edge which is oriented vertically, (ii) the recess of the latch defines a second straight edge which is oriented vertically when the latch is in the closed position and (iii) the second straight edge aligns with the first straight edge to ensure that the cassette remains locked in position until the release tab portion is lifted to move the latch from the closed position to the open position.

11. A media handler according to claim 10, wherein the flag portion comprises a portion extending transversely to the body portion and protruding through a pick unit sidewall.

* * * * *